United States Patent [19]

Yabuki et al.

[11] Patent Number: 4,765,955

[45] Date of Patent: Aug. 23, 1988

[54] CO-BASE ALLOYS FOR ENGINE VALVES AND VALVE SEATS

[75] Inventors: Ritsue Yabuki, Iwatsuki; Junya Ohe, Urawa; Sadao Saitoh, Ohmiya, all of Japan

[73] Assignee: Mitsubishi Kinzoku Kabushiki Kaisha, Japan

[21] Appl. No.: 902,476

[22] Filed: Sep. 2, 1986

Related U.S. Application Data

[63] Continuation of Ser. No. 662,304, Sep. 13, 1984, abandoned.

[30] Foreign Application Priority Data

Jan. 18, 1983 [JP] Japan ..... 58-6099

[51] Int. Cl.[4] ..... C22C 19/07

[52] U.S. Cl. ..... 420/438; 420/583; 420/586; 420/588

[58] Field of Search ..... 420/438, 439, 583, 586, 420/588; 148/425, 442

[56] References Cited

U.S. PATENT DOCUMENTS 4,353,742 10/1982 Crook ..... 420/586

*Primary Examiner*—R. Dean

*Attorney, Agent, or Firm*—McGlew and Tuttle

[57] ABSTRACT

The alloys according to the invention are the Co-base alloys which contain C, Si, Cr, W, Mo, Ti and Al, and further, as necessary, contain one, two or more elements among Mn, Ni, Fe, Nb and B, having high thermal shock resistance and lead oxide corrosion resistance. Furthermore the alloys can be used for build-up welding and casting, therefore they demonstrate excellent performance when used in the manufacture of engine valves and valves seats of high performance engines.

20 Claims, No Drawings

CO-BASE ALLOYS FOR ENGINE VALVES AND VALVE SEATS

This is a continuation of application Ser. No. 662,304 filed Sep. 13, 1984, abandoned.

DETAILED DESCRIPTION OF THE INVENTION

The invention relates to the Co-base alloys having high hardness under high temperature, high thermal shock resistance and high lead oxide-corrosion resistance and suitable for use in casting and build-up welding in the manufacture of engine valves and valve seats of internal combustion engines which particularly require those properties.

In the past, Co-base alloys of American Welding Society Specifications 5.13RCoCr-A, 5.13 RCoCr-B etc. (hereinafter referred to as "prior art Co-base alloys") were being used for build-up welding in the manufacture of engine valves and valve seats of internal combustion engines, the composition of 5.13 RCoCr-A being 0.9-1.4% C, 2.0% or less Si, 1.0% or less Mn, 3.0-6.0% W, 26-32% Cr, 3.0% or less Ni, 3.0% or less Fe, 1.0% or less Mo, and the balance consisting of Co and unavoidable impurities, and that of 5.13 RCoCr-B beingl.2-1.7% C, 2.0% or less Si, 1.0% or less Mn, 7.0-9.5% W, 26-32% Cr, 3.0% or less Ni, 3.0% or less Fe, 1.0% or less Mo, and the balance consisting of Co and unavoidable impurities, respectively in percentage weight.

Meanwhile the improvement of performance of internal combustion engines has recently been contemplated, leading to the requirement for engine valves and valve seats of internal combustion engines provided with better properties. Thus either of them is coming to be required generally to have the properties under build-up weld condition such as the high temperature hardness of 285 or higher in Vickers hardness number at the temperature 800° C., the thermal shock resistance sustaining 7 or more repetitive heating-and-quenching cycles before forming any crack in build-up welds, one cycle consisting of keeping the temperature 700° C. for 15 minutes and quenching in water thereafter, and the lead oxide corrosion resistance of 0.09 g/cm$^2$/hr or less weight reduction after submersion for 1 hour in molten lead oxide heated to the temperature 915° C. Naturally those properties are also required by casting for engine valves and valve seats of internal combustion engines which are manufactured through casting process.

Nevertheless, although the aforementioned prior art Co-base alloys meet the requirement of high temperature hardness mentioned above, they do not have the properties to satisfy the above requirements of thermal shock resistance and lead oxide corrosion resistance, therefore at present the prior art Co-base alloys do not show satisfactory service life enough to use for build-up welding and casting in the manufacture of engine valves and valve seats of high performance engines.

In view of the above, the inventors conducted the research seeking to develop materials having excellent properties in high temperature hardness, thermal shock resistance and lead oxide corrosion resistance which are required for engine valves and valve seats of internal combustion engines, particularly high performance engines and being usable for build-up welding and casting of these products, and finally obtained the knowledge which will be described hereunder.

That is, Co-base alloys having the composition in percentage weight of 0.5-3.5% C, 0.1-3.0% Si, 10-37% Cr, 0.1-17.0% W, 0.1-10.0% Mo, 0.01-4.50% Ti, 0.01-5.50% Al plus, as required, one, two or more elements among 0.01-2.0% Mn, 8-32% Ni, 1-16% Fe, 0.01-1.50% Nb and 0.001-1.50% B, and the balance consisting of Co and unavoidable impurities (preferably 40% or more Co), show extremely raised high temperature hardness of 310 or more in Vickers hardness number at the temperature of 800° C., excellent thermal shock resistance of 8 or more cycles before forming any crack, one cycle consisting of heating at 700° C. for 15 minutes and quenching in water thereafter, and excellent lead oxide corrosion resistance of 0.039 g/cm$^2$/hr or less weight reduction after submersion for 1 hour in molten lead oxide heated to 915° C., and also are usable for build-up welding and casting, therefore these Co-base alloys demonstrate excellent performance for a long period when used in the manufacture of engine valves and valve seats of high performance engines.

The invention was made based on the above-mentioned knowledge, and the reasons for limiting the alloy composition such as above will be explained hereunder.

(a) C

Carbon (C) ingredient acts to combine with Cr, W, Mo, Ti and Nb etc. to form carbides and improve the hardness of alloys under room and high temperatures. But the content less than 0.5% can not yield the desired high hardness, while the content exceeding 3.5% tends to deteriorate the thermal shock resistance, therefore the content has been determined to be 0.5-3.5%.

(b) Si

Silicon (Si) ingredient acts to improve castability, build-up weldability and molten metal fluidity. But the content less than 0.1% can not yield the desired effect of improvement, while the content exceeding 3.0% can not be expected of higher effect of improvement, therefore the content has been determined to be 0.1-3.0%.

(c) Cr

Chromium (Cr) ingredient acts to make solid solution with base metals in part and form the carbide in the remainder, effecting to especially improve the high temperature hardness, thereby improving high temperature wear resistance and additionally improve lead oxide corrosion resistance. But the content less than 10% can not yield the desired effect of the above action, while the content above 37% tends to reduce the thermal shock resistance, therefore the content has been determined to be 10-37%.

(d) W

Wolfram (W) ingredient acts to make carbides fine, also itself make the carbide and form solid solution with base metals, effecting to strengthen the base metals, thereby improving the high temperature hardness and high temperature strength of alloys. But the content less than 0.1% can not yield the desired effect of the above action, while the content exceeding 17.0% tends to deteriorate the build-up weldability and machinability, therefore the content has been determined to be 0.1-17.0%.

(e) Mo

Molybdenum (Mo) ingredient acts to make solid solution with base metals under the coexistence of W to strengthen them and form the carbide, thereby improving the high temperature hardness (high temperature wear resistance) and high temperature strength. But the content less than 0.1% does not yield the desired effect of the above action, while the content above 10.0% tends to deteriorate the thermal shock resistance and toughness, therefore the content has been determined to be 0.1–10.0%.

(f) Ti

Titanium (Ti) ingredient acts to not only suppress the growth of crystalline granules in base metals but make the crystalline granules fine, and form carbides and nitrides of MC type and further intermetalic compounds of $Ni_3(Al, Ti)$ by combining with Ni and Al, thereby improving the high temperature hardness, thermal shock resistance, high temperature strength and toughness. But the content less than 0.01% does not yield the desired effect of the above action, while the content above 4.5% tends to form too much carbides and deteriorate the thermal shock resistance and toughness, and also shows the tendency of deteriorating lead oxide corrosion resistance, therefore the content has been determined to be 0.01–4.50%.

(g) Al

Aluminum (Al) ingredient acts to improve the lead oxide corrosion resistance together with Cr, form intermetalic compounds of $Ni_3(Al, Ti)$ by combining with Ni and Ti as mentioned above and also form the carbide, thereby raising the room and high temperature hardness to further increase the wear resistance and also improving the thermal shock resistance and high temperature strength. But the content less than 0.01% does not yield the desired effect of the above action, while the content above 5.5% tends to not only reduce molten metal fluidity and castability but also deteriorate weldability and toughness, thereby losing practicality, therefore the content has been determined to be 0.01–5.5%.

(h) Mn

Manganese (Mn) ingredient acts to improve build-up weldability, so it is added as necessary when the build-up weldability is especially required. But the content less than 0.01% does not yield desired effect of improvement in build-up weldability, while the content above 2.0% does not show further effect of improvement, therefore the content has been determined to be 0.01–2.0%.

(i) Ni

Nickel (Ni) ingredient acts to not only stabilize austenitic base metals to increase the thermal shock resistance and toughness but also form intermetalic compounds $Ni_3(Al, Ti)$ by combining with Al and Ti to improve the high temperature hardness (high temperature wear resistance) and high temperature strength, and further improve the lead oxide corrosion resistance under the coexistence of Cr, so it is added as necessary when these properties are especially required. But the content less than 8% does not yield the desired effect of the above action, while the content above 32% does not show further effect of improvement, therefore the content has been determined to be 8–32%.

(j) Fe

Iron (Fe) ingredient acts to further improve the thermal shock resistance of alloys, so it is added as necessary when this property is especially required. But the content less than 1% does not yield the desired effect of improvement in the thermal shock resistance, while the content above 16% tends to reduce the high temperature hardness, therefore the content has been determined to be 1–16%.

(k) Nb and B

These ingredients act to further improve the high temperature hardness (high temperature wear resistance) and high temperature strength, so they are added as necessary when those properties are especially required. But the content of each ingradient less than 0.001% does not yield the desired effect of improvement in the above action, while the content of each above 1.5% tends to deteriorate the thermal shock resistance, therefore the contents have been determined to be Nb of 0.01–1.50% and B of 0.001–1.50% respectively.

The Co-base alloys of the invention will now be specifically described hereunder by way of examples while referring to other examples for comparison.

EXAMPLES

The Co-base alloys of the invention No. 1 through 52, the comparing Co-base alloys No. 1 through 10 and the prior art Co-base alloys No. 1 and 2 having the composition equivalent to the aforementioned prior art Co-base alloys, respectively having the compositions shown in Table 1, were prepared by melting and then cast to form welding rods of 4.8 mm dia through continuous casting under the normal condition. The comparing Co-base alloys No. 1 through 10 have the compositions wherein the contents of some of ingradients (those asterisked in Table 1) are out of the limits determined by the invention.

Next a weld bead having a circular-ring shape of 100 mm dia, 20 mm width and 5 mm thickness was built up by double pass build-up welding on a surface of stainless steel (SUS 316) substrate of 120 mm dia and 20 mm thickness with a TIG automatic welding machine, using each of the welding rods of the Co-base alloys of the invention No. 1 through 52, the comparing Co-base alloys No. 1 through 10 and the prior art Co-base alloys No. 1 and 2 which were thus fabricated.

Then each bead formed on the substrate was subjected to the measurements of hardness at the room temperature in Rockwell hardness (C-scale) and hardness at 800° C. in Vickers hardness respectively, and thereafter to the thermal shock resistance test wherein the substrate having the bead of circular-ring shape formed was heated to and kept at 700° C. for 15 minutes and thereafter quenched in water as one cycle, the cycle being repeated, and the number of cycles attained before the formation of cracks in the bead was counted. Similarly using each of the Co-base alloy rods a weld of 5 mm thickness was built by double pass build-up welding on one end surface of a stainless steel (SUS 316) rod having 15 mm dia and 100 mm length, and a test specimen having 12 mm dia and 12 mm thickness was fabricated from this build-up weld. The specimen was subjected to the lead oxide corrosion resistance test wherein the specimen was submerged in the molten lead oxide of 40 g heated to 915° C. for one hour and the reduction of weight of built-up material after the submersion was measured. The results of those tests were summarized and shown in Table 1.

TABLE 1

| Types of Alloys | Composition (weight %) C | Si | Cr | W | Mo | Ti | Al | Mn | Ni | Fe | Nb | B | Co | Room Temp. Hardness ($H_RC$) | High Temp. Hardness ($H_v$) | Thermal Shock Resistance (cycles) | Lead Oxide Corrosion Resistance ($g/cm^2/hr$) |
|---|---|---|---|---|---|---|---|---|---|---|---|---|---|---|---|---|---|
| Co-base Alloys of the Invention | | | | | | | | | | | | | | | | | |
| 1 | 0.53 | 0.70 | 15.0 | 5.1 | 3.2 | 1.10 | 2.50 | — | — | — | — | — | balance | 44 | 310 | 38 | 0.007 |
| 2 | 1.26 | 0.66 | 15.1 | 5.0 | 3.1 | 1.13 | 2.49 | — | — | — | — | — | balance | 45 | 320 | 29 | 0.007 |
| 3 | 2.13 | 0.69 | 15.2 | 5.2 | 3.2 | 1.12 | 2.51 | — | — | — | — | — | balance | 48 | 337 | 24 | 0.008 |
| 4 | 2.78 | 0.67 | 15.0 | 5.1 | 3.1 | 1.11 | 2.50 | — | — | — | — | — | balance | 54 | 350 | 19 | 0.009 |
| 5 | 3.46 | 0.66 | 15.0 | 5.0 | 3.0 | 1.10 | 2.49 | — | — | — | — | — | balance | 59 | 374 | 9 | 0.011 |
| 6 | 1.50 | 0.12 | 35.1 | 3.2 | 5.1 | 0.81 | 1.21 | — | — | — | — | — | balance | 46 | 322 | 30 | 0.016 |
| 7 | 1.48 | 2.91 | 35.0 | 3.1 | 5.0 | 0.80 | 1.22 | — | — | — | — | — | balance | 48 | 330 | 23 | 0.012 |
| 8 | 1.03 | 0.43 | 10.3 | 2.6 | 5.9 | 2.01 | 1.02 | — | — | — | — | — | balance | 44 | 320 | 28 | 0.014 |
| 9 | 1.04 | 0.40 | 36.2 | 2.5 | 5.7 | 2.00 | 1.01 | — | — | — | — | — | balance | 55 | 351 | 13 | 0.004 |
| 10 | 0.90 | 1.51 | 28.1 | 0.11 | 9.0 | 0.75 | 0.30 | — | — | — | — | — | balance | 47 | 330 | 26 | 0.018 |
| 11 | 0.91 | 1.50 | 28.2 | 10.23 | 2.10 | 0.74 | 0.28 | — | — | — | — | — | balance | 52 | 349 | 21 | 0.014 |
| 12 | 0.92 | 1.47 | 28.0 | 16.84 | 0.16 | 0.75 | 0.27 | — | — | — | — | — | balance | 64 | 387 | 9 | 0.011 |
| 13 | 0.95 | 0.97 | 30.1 | 8.9 | 0.12 | 0.56 | 0.63 | — | — | — | — | — | balance | 46 | 328 | 24 | 0.009 |
| 14 | 0.96 | 0.98 | 30.4 | 1.06 | 9.78 | 0.54 | 0.65 | — | — | — | — | — | balance | 57 | 362 | 11 | 0.016 |
| 15 | 1.51 | 0.21 | 25.1 | 6.1 | 3.1 | 0.011 | 3.06 | — | — | — | — | — | balance | 48 | 328 | 28 | 0.009 |
| 16 | 1.50 | 0.22 | 25.0 | 6.1 | 3.2 | 2.35 | 1.51 | — | — | — | — | — | balance | 50 | 335 | 24 | 0.012 |
| 17 | 1.52 | 0.21 | 25.1 | 6.0 | 3.0 | 3.26 | 1.03 | — | — | — | — | — | balance | 57 | 360 | 17 | 0.023 |
| 18 | 1.50 | 0.20 | 25.4 | 5.9 | 3.1 | 4.47 | 0.08 | — | — | — | — | — | balance | 62 | 375 | 10 | 0.039 |
| 19 | 1.53 | 0.30 | 25.7 | 2.8 | 5.6 | 3.56 | 0.012 | — | — | — | — | — | balance | 47 | 332 | 22 | 0.026 |
| 20 | 1.54 | 0.31 | 25.6 | 2.9 | 5.8 | 1.72 | 2.69 | — | — | — | — | — | balance | 51 | 347 | 18 | 0.014 |
| 21 | 1.52 | 0.31 | 25.6 | 3.0 | 5.5 | 1.01 | 3.65 | — | — | — | — | — | balance | 60 | 365 | 14 | 0.009 |
| 22 | 1.50 | 0.30 | 25.2 | 2.7 | 5.4 | 0.05 | 5.41 | — | — | — | — | — | balance | 64 | 378 | 8 | 0.004 |
| 23 | 2.01 | 2.51 | 30.1 | 7.4 | 2.9 | 1.20 | 0.11 | 0.013 | — | — | — | — | balance | 46 | 326 | 29 | 0.011 |
| 24 | 2.02 | 2.53 | 30.0 | 7.5 | 2.7 | 1.19 | 0.13 | 0.68 | — | — | — | — | balance | 49 | 338 | 24 | 0.014 |
| 25 | 2.01 | 2.52 | 30.3 | 7.3 | 2.7 | 1.20 | 0.10 | 1.86 | — | — | — | — | balance | 51 | 342 | 20 | 0.016 |
| 26 | 2.51 | 1.04 | 15.1 | 2.6 | 3.0 | 0.89 | 1.53 | — | 8.8 | — | — | — | balance | 45 | 329 | 31 | 0.010 |
| 27 | 2.52 | 1.03 | 15.2 | 2.4 | 3.2 | 0.86 | 1.52 | — | 20.4 | — | — | — | balance | 50 | 347 | 26 | 0.012 |
| 28 | 2.50 | 1.05 | 15.0 | 2.7 | 3.1 | 0.88 | 1.54 | — | 31.4 | — | — | — | balance | 52 | 353 | 22 | 0.013 |
| 29 | 3.31 | 1.80 | 20.4 | 10.3 | 2.5 | 1.70 | 2.01 | — | — | 1.2 | — | — | balance | 51 | 346 | 18 | 0.008 |
| 30 | 3.30 | 1.83 | 20.3 | 10.0 | 2.4 | 1.68 | 2.03 | — | — | 15.6 | — | — | balance | 47 | 328 | 32 | 0.015 |
| 31 | 1.25 | 1.35 | 29.7 | 3.5 | 1.6 | 2.52 | 3.04 | — | — | — | 0.012 | — | balance | 46 | 330 | 26 | 0.012 |
| 32 | 1.24 | 1.36 | 29.6 | 3.7 | 1.5 | 2.50 | 3.01 | — | — | — | 0.77 | — | balance | 50 | 349 | 20 | 0.014 |
| 33 | 1.22 | 1.35 | 29.4 | 3.4 | 1.5 | 2.51 | 3.02 | — | — | — | 1.46 | — | balance | 54 | 360 | 12 | 0.015 |
| 34 | 1.03 | 2.01 | 26.6 | 1.5 | 0.7 | 0.92 | 0.56 | — | — | — | — | 0.011 | balance | 45 | 328 | 31 | 0.016 |
| 35 | 1.04 | 2.03 | 26.4 | 1.6 | 0.8 | 0.91 | 0.51 | — | — | — | — | 0.69 | balance | 48 | 339 | 22 | 0.013 |
| 36 | 1.01 | 2.00 | 26.2 | 1.6 | 0.5 | 0.93 | 0.53 | — | — | — | — | 1.46 | balance | 53 | 355 | 11 | 0.010 |
| 37 | 1.24 | 0.61 | 1.51 | 5.1 | 3.0 | 1.16 | 2.53 | — | — | — | 0.83 | 0.062 | balance | 49 | 336 | 24 | 0.006 |
| 38 | 1.26 | 0.60 | 14.9 | 5.3 | 3.2 | 1.20 | 2.50 | 0.80 | 28.7 | — | — | — | balance | 50 | 341 | 28 | 0.008 |
| 39 | 1.26 | 0.62 | 1.50 | 5.1 | 3.1 | 1.21 | 2.52 | 1.52 | — | 14.9 | — | — | balance | 48 | 327 | 33 | 0.016 |
| 40 | 1.27 | 0.61 | 15.1 | 5.0 | 3.1 | 1.19 | 2.50 | 0.43 | — | — | 1.27 | — | balance | 49 | 335 | 24 | 0.015 |
| 41 | 1.23 | 0.59 | 15.1 | 4.9 | 3.0 | 1.16 | 2.49 | 0.24 | — | — | — | 1.261 | balance | 51 | 341 | 18 | 0.011 |
| 42 | 1.27 | 0.61 | 15.0 | 5.1 | 3.1 | 1.15 | 2.51 | — | 15.6 | 10.2 | — | — | balance | 49 | 344 | 29 | 0.013 |
| 43 | 1.25 | 0.60 | 15.2 | 5.0 | 3.1 | 1.17 | 2.53 | — | 21.1 | — | 0.76 | — | balance | 51 | 350 | 26 | 0.013 |
| 44 | 1.25 | 0.60 | 15.1 | 4.9 | 3.0 | 1.15 | 2.50 | — | 26.0 | — | 0.08 | 0.802 | balance | 53 | 357 | 22 | 0.011 |
| 45 | 1.24 | 0.65 | 15.2 | 5.1 | 3.1 | 1.20 | 2.51 | — | — | 9.8 | — | 0.503 | balance | 50 | 336 | 30 | 0.012 |
| 46 | 1.25 | 0.62 | 15.1 | 5.0 | 3.2 | 1.18 | 2.50 | — | — | 10.2 | 1.07 | — | balance | 49 | 334 | 31 | 0.016 |

TABLE 1-continued

| Types of Alloys | Composition (weight %) | | | | | | | | | | | | | Room Temp. Hardness ($H_RC$) | High Temp. Hardness ($H_v$) | Thermal Shock Resistance (cycles) | Lead Oxide Corrosion Resistance ($g/cm^2/hr$) |
|---|---|---|---|---|---|---|---|---|---|---|---|---|---|---|---|---|---|
| | C | Si | Cr | W | Mo | Ti | Al | Mn | Ni | Fe | Nb | B | Co | | | | |
| 47 | 1.27 | 0.63 | 15.3 | 5.1 | 3.2 | 1.16 | 2.52 | 1.02 | 9.7 | 3.2 | — | — | balance | 50 | 347 | 29 | 0.014 |
| 48 | 1.27 | 0.61 | 15.1 | 5.3 | 3.1 | 1.17 | 2.53 | 0.51 | 20.4 | — | 0.56 | 0.009 | balance | 52 | 350 | 24 | 0.012 |
| 49 | 1.26 | 0.61 | 15.0 | 5.1 | 3.1 | 1.20 | 2.51 | — | 22.7 | 5.8 | — | 0.011 | balance | 52 | 353 | 28 | 0.012 |
| 50 | 1.27 | 0.62 | 15.1 | 5.0 | 3.0 | 1.16 | 2.53 | 0.68 | — | 4.9 | 1.40 | — | balance | 51 | 340 | 30 | 0.017 |
| 51 | 1.24 | 0.60 | 15.2 | 5.1 | 3.0 | 1.15 | 2.50 | 0.11 | — | 7.2 | — | 1.02 | balance | 53 | 348 | 28 | 0.011 |
| 52 | 1.25 | 0.61 | 15.1 | 5.0 | 3.1 | 1.12 | 2.51 | 0.09 | 15.1 | 9.9 | 0.54 | 0.031 | balance | 54 | 351 | 26 | 0.012 |
| Comparing Co-base Alloys | | | | | | | | | | | | | | | | | |
| 1 | 0.36* | 0.68 | 15.1 | 5.0 | 3.3 | 1.09 | 2.51 | — | — | — | — | — | balance | 42 | 299 | 45 | 0.007 |
| 2 | 3.69* | 0.67 | 15.2 | 5.1 | 3.1 | 1.10 | 2.48 | — | — | — | — | — | balance | 62 | 380 | 1 | 0.012 |
| 3 | 1.04 | 0.45 | 8.6* | 2.7 | 5.8 | 2.02 | 1.03 | — | — | — | — | — | balance | 43 | 305 | 30 | 0.019 |
| 4 | 1.05 | 0.42 | 39.1* | 2.6 | 5.6 | 2.01 | 1.01 | — | — | — | — | — | balance | 59 | 360 | 4 | 0.002 |
| 5 | 0.91 | 1.51 | 28.3 | —* | 9.01 | 0.76 | 0.31 | — | — | — | — | — | balance | 43 | 304 | 28 | 0.024 |
| 6 | 0.96 | 0.97 | 30.1 | 9.8 | —* | 0.58 | 0.62 | — | — | — | — | — | balance | 44 | 306 | 23 | 0.008 |
| 7 | 0.95 | 0.96 | 30.3 | 1.10 | 11.2* | 0.60 | 0.64 | — | — | — | — | — | balance | 59 | 370 | 4 | 0.023 |
| 8 | 1.50 | 0.22 | 25.3 | 6.1 | 3.0 | —* | 3.00 | — | — | — | — | — | balance | 45 | 305 | 8 | 0.007 |
| 9 | 1.51 | 0.21 | 25.5 | 6.0 | 3.2 | 4.71* | 0.09 | — | — | — | — | — | balance | 64 | 378 | 3 | 0.046 |
| 10 | 1.54 | 0.31 | 25.9 | 2.7 | 5.7 | 3.50 | —* | — | — | — | — | — | balance | 45 | 302 | 20 | 0.040 |
| Prior Art Co-base Alloys | | | | | | | | | | | | | | | | | |
| 1 | 1.01 | 1.47 | 28.1 | 4.03 | — | — | — | 0.78 | — | — | — | — | balance | 44 | 280 | 5 | 0.109 |
| 2 | 1.37 | 1.49 | 29.0 | 8.01 | — | — | — | 0.79 | — | — | — | — | balance | 47 | 291 | 3 | 0.103 |

It is obvious from the results shown in Table 1 that either of the Co-base alloys of the invention No. 1 through 52 has superior properties in the high temperature hardness, thermal shock resistance and lead oxide corrosion resistance to the conventional Co-base alloys. On the other hand, as shown by the comparing Co-alloys No. 1 through 10, if the content of any one of ingradients is out of the limit according to the invention, at least same property among those mentioned above tends to be inferior to that of the Co-base alloys of the invention.

Further, while the results of Co-base alloys of the invention were described in the usage of build-up welding, it is natural that those alloys show excellent properties in the usage of casting as well.

As heretofore mentioned, the Co-base alloys of the invention have excellent high temperature hardness, thermal shock resistance and lead oxide corrosion resistance sufficiently enough to meet the severe conditions required for engine valves and valve seats of high performance engines, so that those parts turn out to demonstrate excellent performances for very long period if the Co-base alloys of the invention are used for build-up welding and casting in the manufacture of those parts.

What is claimed is:

1. Co-base alloys for use in engine valves and valve seats of internal combustion engines, characterized by a Vickers hardness number of at least 310 at 800 degrees C., a thermal shock resistance of at least 8 cycles, each cycle consisting of a 15-minute heating at 700 degrees C. followed by water quenching, and a lead oxide corrosion value not greater than 0.039 g/cm$^2$/hr after submersion for 1 hour in molten lead oxide, said alloys consisting of the following composition, by weight: 0.5–3.5% C; 0.1–3.0% Si; 10–37% Cr; 0.1–17.0% W, 0.1–10.0% Mo; 0.01–4.5% Ti; 0.01–5.5% Al; balance 42–77% Co; and incidental impurities.

2. Co-base alloys for use in engine valves and valve seats of internal combustion engines, characterized by a Vickers hardness number of at least 310 at 800 degrees C., a thermal shock resistance of at least 8 cycles, each cycle consisting of a 15-minute heating at 700 degrees C. followed by water quenching, and a lead oxide corrosion value not greater than 0.039 g/cm$^2$/hr after submersion for 1 hour in molten lead oxide, said alloys consisting of the following composition, by weight: 0.5–3.5% C; 0.1–3.0% Si; 10–37% Cr; 0.1–17.0% W, 0.1–10.0% Mo; 0.01–4.5% Ti; 0.01–5.5% Al; one or more elements selected from 0.01–2.0% Mn, 8–32% Ni, 1–16% Fe, 0.01–1.5% Nb and 0.001–1.5% B; balance 42–77% Co; and incidental impurities.

3. Co-base alloys according to claim 2, wherein said one or more selected elements is 0.01–2.0% Mn.

4. Co-base alloys according to claim 2, wherein said one or more selected elements is 8–32% Ni.

5. Co-base alloys according to claim 2, wherein said one or more selected elements is 1–16% Fe.

6. Co-base alloys according to claim 2, wherein said one or more selected elements are 0.01–1.50% Nb and/or 0.001–1.50% B.

7. Co-base alloys according to claim 2, wherein said one or more selected elements are 0.01–2.0% Mn and 8–32% Ni.

8. Co-base alloys according to claim 2, wherein said one or more selected elements are 0.01–2.0% Mn and 1–16% Fe.

9. Co-base alloys according to claim 2, wherein said one or more selected elements are 0.01–2.0% Mn together with 0.01–1.50% Nb and/or 0.001–1.50% B.

10. Co-base alloys according to claim 2, wherein said one or more selected elements are 8–32% Ni and 1–16% Fe.

11. Co-base alloys according to claim 2, wherein said one or more selected elements are 8–32% Ni together with 0.01–1.5% Nb and 0.001–1.5% B.

12. Co-base alloys according to claim 2, wherein said one or more selected elements are 1–16% Fe together with 0.01–1.5% Nb and 0.001–1.5% B.

13. Co-base alloys according to claim 2, wherein said one or more selected elements are 0.01–2.0% Mn, 8–32% Ni and 1–16% Fe.

14. Co-base alloys according to claim 2, wherein said one or more selected elements are 0.01–2.0% Mn and 8–32% Ni, together with 0.01–1.5% Nb and/or 0.001–1.5% B.

15. Co-base alloys according to claim 2, wherein said one or more selected elements are 8–32% Ni and 1–16% Fe, together with 0.01–1.5% Nb and/or 0.001–1.5% B.

16. Co-base alloys according to claim 2, wherein said one or more selected elements are 0.01–2.0% Mn and 1–16% Fe, together with 0.01–1.5% Nb and/or 0.001–1.5% B.

17. Co-base alloys according to claim 2, wherein said one or more selected elements are 0.01–2.0% Mn, 8–32% Ni and 1–16% Fe, together with 0.01–1.50% Nb and/or 0.001–1.5% B.

18. Co-base alloys for use in engine valves and valve seats of internal combustion engines, characterized by a Vickers hardness number of at least 310 at 800 degrees C., a thermal shock resistance of at least 8 cycles, each cycle comsisting of a 15-minute heating at 700 degrees C. followed by water quenching, and a lead oxide corrosion value not greater than 0.039 g/cm$^2$/hr after submersion for 1 hour in molten lead oxide, said alloys consisting of the following composition, by weight: 0.5–3.5% C; 0.1–3.0% Si; 10–37% Cr; 0.1–17.0% W; 0.1–10.0% Mo; 0.1–4.5% Ti; 0.1–5.5% Al; 42–77% Co; and incidental impurities.

19. Co-base alloys for use in engine valves and valve seats of internal combustion engines, characterized by a Vickers hardness number of at least 310 at 800 degrees C., a thermal shock resistance of at least 8 cycles, each cycle consisting of a 15-minute heating at 700 degrees C. followed by water quenching, and a lead oxide corrosion value not greater than 0.039 g/cm$^2$/hr after submersion for 1 hour in molten lead oxide, said alloys consisting of the following composition, by weight: 0.5–3.5% C; 0.1–3.0% Si; 10–37% Cr; 0.1–17.0% W, 0.1–10.0% Mo; 0.1–4.5% Ti; 0.01–5.5% Al; one or more elements selected from 0.01–2.0% Mn, 8–32% Ni, 1–16% Fe, 0.01–1.50% Nb and 0.001–1.50% B; 42–77% Co; and incidental impurities.

20. A combustion engine valve or valve seat having a Vickers hardness number of at least 310 at 800 degrees C., a thermal shock resistance of at least 8 cycles, each cycle consisting of a 15-minute heating at 700 degrees C. followed by water quenching, and a lead oxide corrosion value not greater than 0.039 g/cm$^2$/hr after submersion for 1 hour in molten lead oxide, said properties being the result of the following alloyed composition, consisting of by weight, of said valve or valve seat: 0.5–3.5% C; 0.1–3.0% Si; 10–37% Cr; 0.1–17.0% W; 0.1–10% Mo; 0.01–4.5% Ti; 0.01–5.5% Al; 42–77% Co; and incidental impurities.

* * * * *